United States Patent [19]

Brandt

[11] 4,282,666

[45] Aug. 11, 1981

[54] METHOD AND APPARATUS FOR BREAKING HARD SNOW

[76] Inventor: Claude R. Brandt, R.D. 2, Corinth Rd., Glens Falls, N.Y. 12801

[21] Appl. No.: 93,225

[22] Filed: Nov. 13, 1979

Related U.S. Application Data

[63] Continuation-in-part of Ser. No. 593,732, Jul. 7, 1975, abandoned.

[51] Int. Cl.[3] ..... E01M 5/00

[52] U.S. Cl. ..... 37/195; 37/43 R; 172/540

[58] Field of Search ..... 37/10, 43 R, 108, 41, 37/195; 172/54 D, 525, 145, 610, 69, 464, 579; 404/122, 123, 130, 132, 190; 47/1, 58

[56] References Cited

U.S. PATENT DOCUMENTS

| | | | |
|---|---|---|---|
| 64,748 | 5/1867 | Colcord | 404/130 |
| 645,032 | 3/1900 | Johanson | 172/540 |
| 2,054,129 | 9/1936 | Kelsey | 172/540 |
| 2,708,866 | 5/1955 | Shonts | 172/540 |
| 2,786,283 | 3/1957 | Bradley | 37/10 |
| 3,101,932 | 8/1963 | Wright | 37/108 R |
| 3,136,078 | 6/1964 | Renault | 404/90 X |
| 3,297,096 | 1/1967 | Wooldridge | 37/10 |
| 3,346,973 | 10/1967 | Meyer et al. | 37/10 |
| 3,371,586 | 3/1968 | Nikolaev et al. | 404/91 |
| 3,739,859 | 6/1973 | White | 172/145 |

FOREIGN PATENT DOCUMENTS

| | | | |
|---|---|---|---|
| 1248085 | 8/1967 | Fed. Rep. of Germany | 172/122 |
| 773163 | 3/1955 | United Kingdom | 37/43 |

OTHER PUBLICATIONS

"Rolling Cultivator," Owner's Manuel Model 2000, Lilliston Implement Co. pp. 1-11, 3-20-65.

"Rolling Cultivator," Parts Book Model 2000, Lilliston Implement Co. pp. 1-25, 3-20-65.

*Primary Examiner*—E. H. Eickholt

*Attorney, Agent, or Firm*—Paul H. Gallagher

[57] ABSTRACT

Method and apparatus for breaking hard snow such as has been thawed and later frozen, and having glazed top surface and consisting of a solid mass to a substantial depth. The apparatus for performing that method includes a plurality of spiders or wheels having spikes or teeth that are generally radial. The device is drawn along an area in which the snow is to be broken, such as a ski trail, the spiders rolling as the device is moved therealong, and the teeth penetrating into the snow, digging out and removing portions of the hard snow, forming a top layer of loose snow and a bottom layer of hard snow as part of the original solid mass and forming holes or pits in the surface of the bottom layer. The top layer of loose snow includes chunks and these are later crushed at least partially, such as by a roller, rolling thereover, reducing the size of the chunks and forming at least a portion of fine snow. The holes are in the neighborhood of 2" to 4" wide at the top, and spaced apart a distance about twice that dimension, and of a depth similar to their width.

9 Claims, 15 Drawing Figures

Fig. 11.
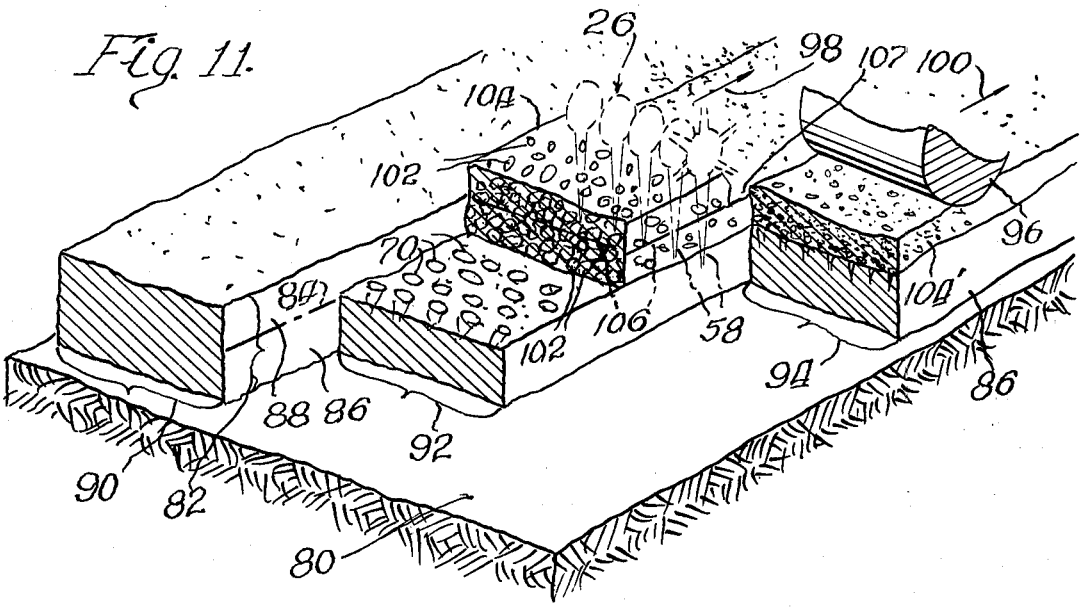
Fig. 12.
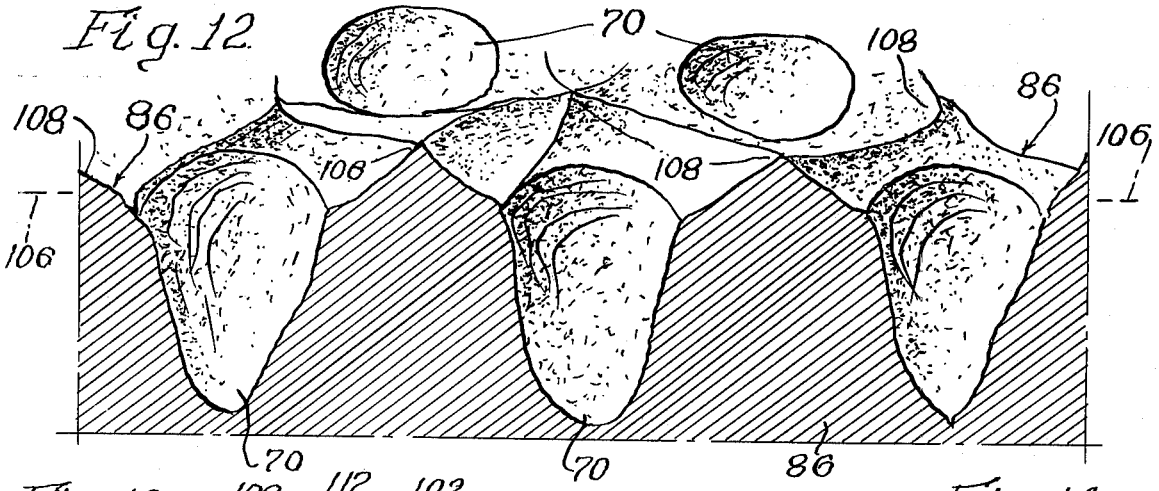
Fig. 13.
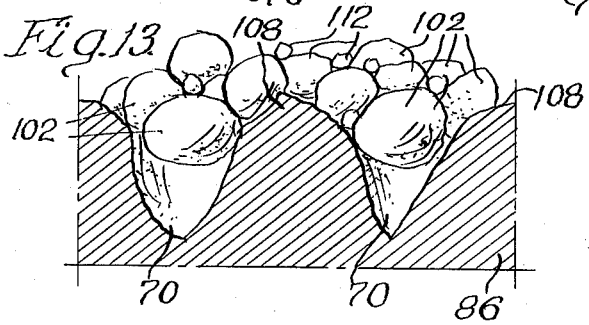
Fig. 14.
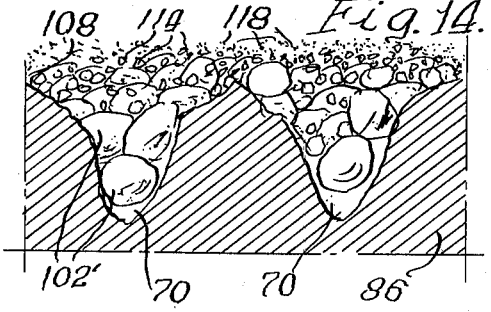
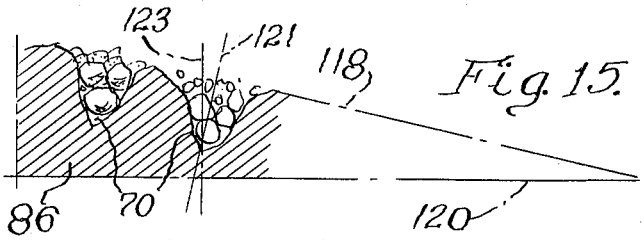
Fig. 15.

METHOD AND APPARATUS FOR BREAKING HARD SNOW

This is a continuation-in-part of Ser. No. 593,732, filed July seventh, 1975 and now abandoned.

FIELD OF THE INVENTION

The present invention has to do with breaking up hard snow, a common example of which is so breaking it up on a ski trail. When snow thaws, the resulting water seeps down through the mass of snow, at least to a certain depth, many times to a considerable depth, and at a later freeze the snow becomes hard, having a glazed top surface and forming a hard mass to the depth to which the water seeped. This hard snow is similar to ice and is sometimes referred to as such. Such a condition of a ski trail is of course undesirable, since the skis are uncontrollable, particularly sideways, and also at least to an extent in forward direction. Accordingly it is necessary to break the glazed top surface, and to break up the hard mass to a depth therebelow. Reconditioning of such snow has been performed previously in a general way, and the present invention relates to a method and apparatus for so breaking the snow in a better and more effective manner.

OBJECTS OF THE INVENTION

A broad object of the invention is to provide a novel method and apparatus for breaking hard snow.

Another broad object is to provide novel method and apparatus for breaking hard snow to a certain depth, forming a bottom layer having a sub-surface with a top layer of loose snow thereon, in which the sub-surface is rough, having holes or pits therein, in which the loosened snow rests, and thereby the loosened snow is more effectively retained in place on the sub-surface against tendencies to displace it, such as by ski-ing thereon.

Still another object is to provide method and apparatus of the character referred to whereby the loosened snow forms a layer that is deeper than was practicable heretofore, and remains useful for a longer period of time for human activity thereon, such as ski-ing.

Still another object is to provide method and apparatus of the kind referred to in the use of which the loosened snow includes large chunks or particles, and smaller particles such as of granular size, the larger particles are held effectively by the holes in the sub-surface, and the snow of smaller size is held by the larger particles, and near the top of the loosened snow, the granular size snow provides a good surface for ski-ing.

A further and specific object is to provide apparatus of the foregoing character which requires a minimum amount of power for pulling it for performing the snow-breaking operation.

DESCRIPTION OF A PREFERRED EMBODIMENT

In the drawings:

FIG. 11 is a schematic view of a bed or main layer of snow showing three stages or phases of the snow in the snow-breaking operation;

FIG. 12 is a large scale sectional view taken at line 12—12 of FIG. 7;

FIG. 13 is a small scale view similar to FIG. 12 but showing large chunks in the holes;

FIG. 14 is a view similar to FIG. 12 but showing the chunks in smaller size, and snow of granular size, after the rolling operation; and FIG. 15 is a view similar to FIG. 14 but oriented according to the sloping surface of a hill.

Figure 1:
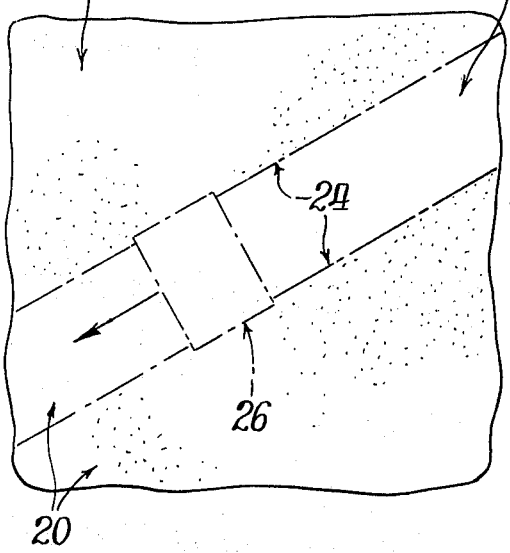
FIG. 1 is a representation of an area covered with snow.

Referring in detail to the drawings, attention is directed first to FIG. 1, which includes an overall snow covered area 20 in which the ski trail 22 is defined by the dot-dash lines 24. As indicated above, the ski trail must be treated or reconditioned periodically, to break the hard snow that forms on it. The snow becomes hard due to thawing and later freezing, and after it does become hard it is necessary to break it. This is done by producing a top layer of loosened snow of desired depth.

Figure 2:
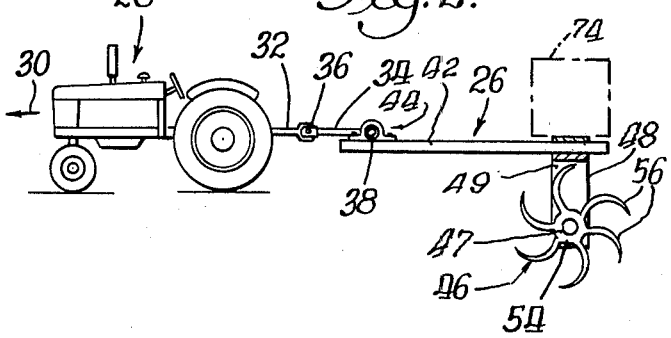
FIG. 2 is a side view diagrammatic in nature showing the apparatus in conjunction with the tractor for pulling it, certain minor portions being shown in section.

In order to facilitate description of the method of the invention, a description will first be made of the apparatus by which the method is carried out. In FIG. 2 the apparatus, or snow breaker, utilized is indicated as a whole at 26 being drawn by a tractor in forward direction indicated by the arrow 30. The tractor 28 is illustrated as a wheeled tractor, but of course any specific form will be satisfactory, such as a track laying tractor. The tractor has the usual draw bar 32 to which the tongue 34 of the snow breaker is connected, preferably by means of a universal connector 36. It is desired that the snow breaker 26 be connected to the tractor at a single point such as by a universal connector 36 for greater efficiency and facility in pulling the snow breaker.

Figure 3:
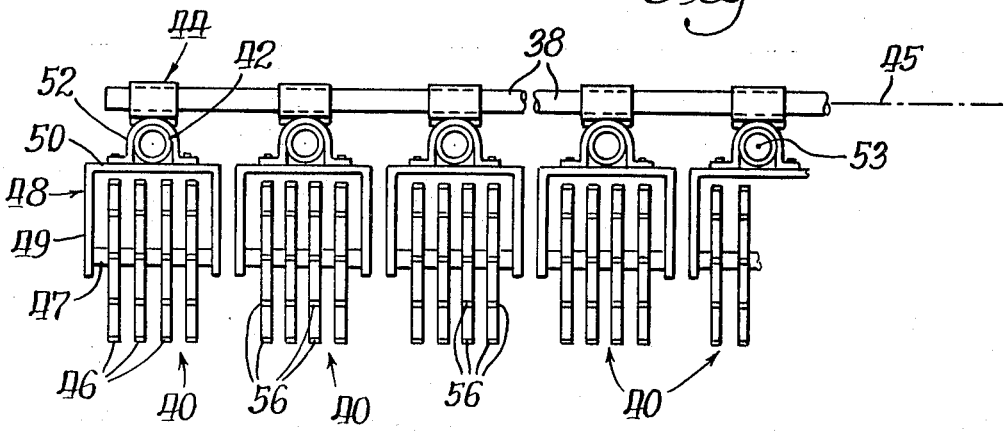
FIG. 3 is a rear view of the apparatus, certain of the duplicated units of the apparatus being only indicated.
Figure 4:
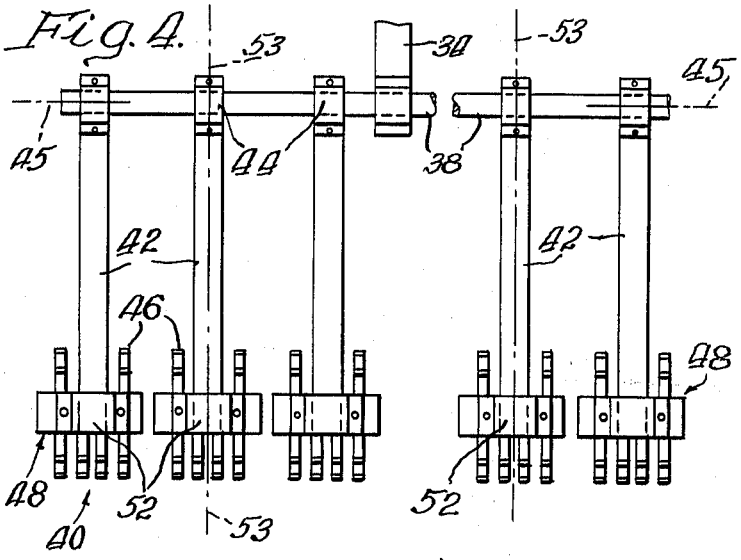
FIG. 4 is a top view of the apparatus also in which certain of the duplicated units of the apparatus are only indicated.

Attention is directed to FIGS. 2–4 for the general mechanical construction of the snow breaker. These figures show one form of construction, but modified forms of specific details of structure are also illustrated in other figures and described hereinbelow. In the snow breaker, the tongue 34 is connected to a transverse bar 38 at the leading end of the device. Connected to the transverse bar 38 are a plurality of units 40 all of which may be identical in construction. Each unit 40 includes a longitudinal or forwardly extending piece 42 connected to the transverse bar 38 by any suitable connection 44, preferably of a character enabling the unit to swing vertically to a limited extent about the axis 45 of the transverse bar 38.

Mounted on the rear or trailing end of the piece 42 are a plurality of spiders or wheels 46 to be described in detail hereinbelow which may be mounted on a suitable axle 47 mounted in a holder or bracket 48, being so mounted in the legs 49 thereof which depend from the top cross piece 50. The holder 48 is secured on the rear end of the piece 42 by suitable means 52 which may be similar to the securing means 44, for enabling the holder with the wheels 46 therein to have a limited range of swinging movement about the longitudinal axis 53 of the piece 42.

Figure 5:
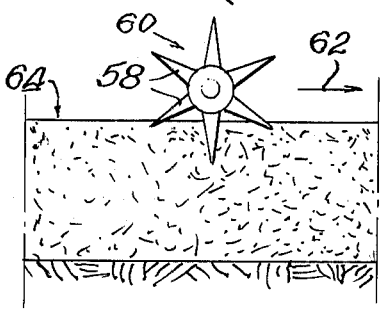
FIG. 5 is the fragmentary diagrammatic representation of a step in the actual breaking of the snow, and also showing an alternate form of the spider.
Figure 6:
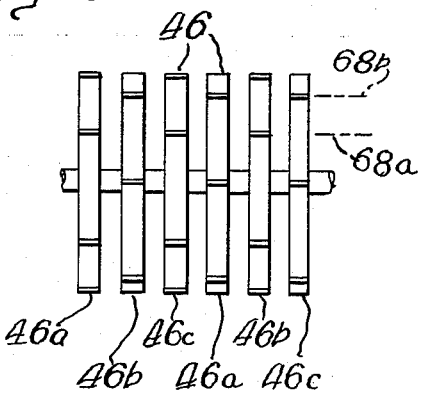
FIG. 6 is a fragmentary view showing certain spiders with an alternate form of arrangement of teeth.

Attention is directed to FIGS. 2, 5 and 6 for certain preferred forms of spider. Each spider may be an integral casting and includes a hub 54 and a plurality of spikes or teeth 56 extending from the hub in a general radial direction. In one form, the spikes may be curved as at 56 in FIG. 2 and preferably they are tapered to a relatively sharp point, or the teeth may be straight as indicated at 58 in FIG. 5, on the spider 60. In this case also, the spikes 58 are preferably pointed, in both cases for ease in penetrating the hard snow.

The snow breaker may be of any desired transverse width, according to the width of the ski trail to be conditioned. Such a ski trail may be for example 12 feet wide, or of other width, and the units 40 provided in number according to that width. In the present instance each unit 40 is represented as having four spiders or wheels, but this number is merely representative, and it may of course contain more than four.

FIG. 1 represents the snow breaker 26 being pulled along the ski trail 22. The spiders 46 rest on the snow and as the snow breaker is pulled, the spiders rotate and the teeth penetrate into the hard snow covering, as indicated above, the entire width of the ski path. FIGS. 5 and 11 show this precise step, the arrow 62 indicating the direction of travel.

Figure 10:
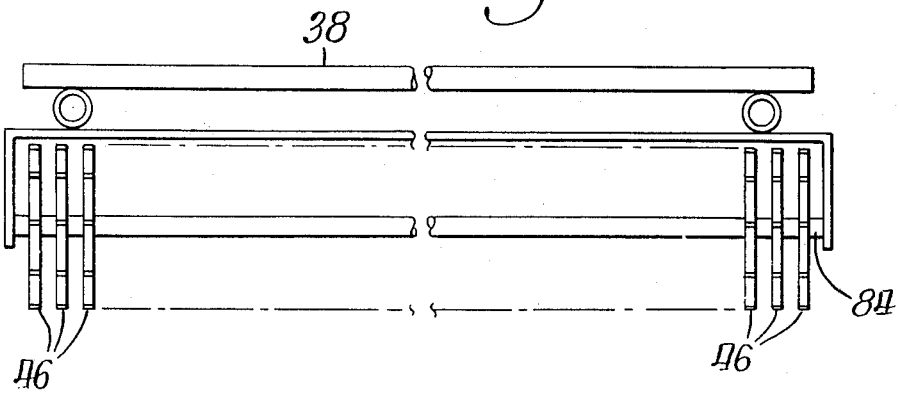
FIG. 10 is a rear view of a modified form of apparatus.

Although the preferred form of the snow breaker includes individual units 40 as described in connection with FIGS. 3 and 4, the invention also includes an arrangement such as shown in FIG. 10 wherein the spiders 46 are all arranged on a common and continuous axle 66. While a ski trail is seldom straight transversely, it may be so at times, and in that case if it should be desired to use the structure shown in FIG. 10, it would be practical.

In the use of a spider 46 as shown in FIG. 2 which has curved spikes, it is within the scope of the invention to have the spikes curved in either direction, forward or reverse, relative to the direction of movement of the snow breaker.

Figure 7:
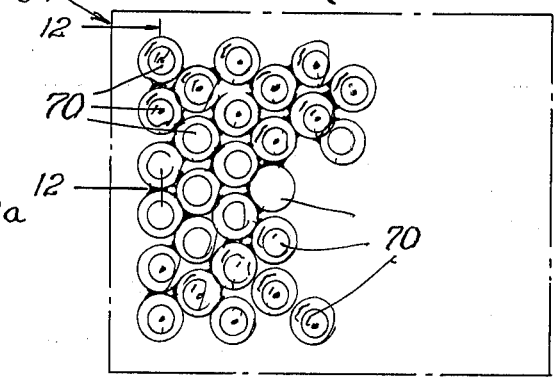
FIG. 7 is a diagrammatic plan view of the bottom layer of hard snow in which the holes are formed, and showing those holes.

FIGS. 3 and 4 show spiders 46 with the spikes in successive and adjacent spiders in axial alignment, but a preferred form is as represented in FIG. 6. In this construction the spiders 46 are locked on the axle or shaft 66 in successively staggered relation, i.e., referring to the spiders individually as 46*a*, 46*b*, 46*c*, the spikes on the spider 46*a* are offset circumferentially a distance equal to one half of the spacing therebetween relative to those on 46*b*, and the latter are offset a smiliar amount relative to those on 46*c*, etc. The spikes on alternate wheels are thus in axial alignment, the overall arrangement being indicated by the dot-dash lines 68*a*. 68*b*, the former showing the spikes on the spiders 46*a*, 46*c* in alignment, and the latter the spikes on the spider 46*b* spaced midway therebetween. FIG. 7 shows a fragment of the bottom layer 86 of snow as will be referred to hereinbelow, with the loosened snow removed therefrom, exposing holes 70 formed by the spikes. These holes are arranged in a staggered fashion corresponding to the staggered relation of the spiders referred to, as will be understood. The specific arrangement of the holes will be referred to again hereinbelow. If desired, an extra weight 74 may be placed on the breaker to effect greater penetration of the teeth, and this factor may vary according to the condition of the snow. With respect to the extent of penetration, attention is directed to the description hereinbelow.

Figure 8:
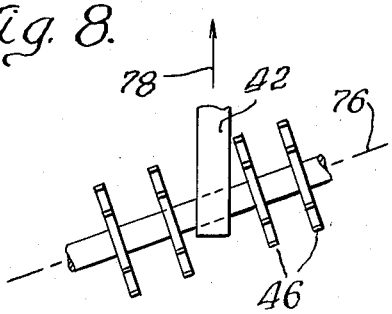
FIG. 8 is a top view of one unit of the apparatus arranged in alternate position relative to the line of travel.
Figure 9:
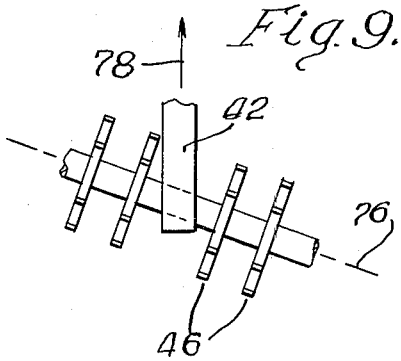
FIG. 9 is a view similar to FIG. 8 but with the unit arranged in another direction relative to the line of travel.

The units 40 may be arranged with the spiders 46 on an axis extending directly transversely to the ski trail or it may be desired to have them on an axis 76 (FIGS. 8 and 9) which is at an acute angle to the direction of movement of the breaker indicated by the arrow 78. FIG. 8 shows the axis 76 positioned on one direction while FIG. 9 shows that axis positioned in another direction.

FIG. 11 is a schematic representation of snow to be treated, with indications on the different stages or phases thereof in the treatment made, namely breaking the hard snow and crushing or pulverizing a portion of the loose snow. The snow previously indicated at 64 is here shown lying on the ground 80 and is in the form of a main total layer 82 of hard snow, i.e., the snow as it lies on the ground in natural condition, it being that snow that is to be broken as on a ski trail. This main layer of hard snow extends over the ground throughout a great area, that is, it is general, but it does of course include the ski trail to be conditioned. The snow may be a hard mass throughout its entire depth, or throughout a substantial depth from the top down, throughout which the use of the present invention is effective. In this main layer 82 is a dot-dash line 84 dividing the main mass into two positions that will become a bottom layer 86 and a top layer 88. The top layer 88 in the present instance may be on the order of 4 inches deep, and the bottom layer having an indeterminate depth. The four inch depth of the top layer is that depth which the snow breaker of the invention, in a suitable size and scale, penetrates and conditions the snow for providing the improved surface to the ski trail.

In FIG. 11 the snow includes an area or strip 90 in its original form of the main layer 82, for comparison purposes. Also shown is a second area or strip 92 over which the snow breaker 26, also shown, has passed, and further it includes a third area or strip 94 over which a compacting or crushing roller 96 has passed. The breaker 26 and roller 96 are drawn in the direction of the arrows 98, 100, respectively.

Upon passing over the snow by the snow breaker 26 the spikes penetrate into the snow mass a predetermined depth, which in the selected example, is about 4 inches. This penetration of the spikes forms holes or pits or pocks 70 which extend down into the bottom layer 86, and gouge our chunks or chips 102 from those holes which then lie over the bottom layer 86, and this forms a top layer now designated 104 which is the snow of the layer 88, but in loosened form. The specific character of this loosened snow will be referred to again hereinbelow.

Upon the roller 96 being drawn over the snow, the snow is crushed and compacted and the top layer 104 is correspondingly compacted and now designated 104'. The character and extent of this compacting also will be referred to hereinbelow.

The roller 96 may be of any suitable character, having sufficient weight for the intended purposes, and may be drawn individually, or in tandem with the snow breaker 26.

Attention is directed to FIGS. 12–15 illustrating specific details of the condition of the snow after its treatment by the method and apparatus of the invention. In FIG. 12, a number of the holes or pits 70 are shown, these holes being gouged out by the spikes of the spiders as referred to. These holes are generally circular in cross section, although not accurately so, most of them being jagged, but they are generally round, not being particularly greater in any transverse direction than any other such direction. In a specific example of the size and scale of the apparatus utilized, the holes are in the order of 2 inches deep, and 2 inches across at the top. They are spaced apart, center to center, in the neighborhood of 4 inches. It is important that these dimensions not be considered limiting, but only as examples. They may be 3 or 4 or 5 inches, or even more, in depth, and three or four inches in width at the top. Moreover, they may be spaced apart at 5 or 6 inches on centers, or even less than the 4 inches indicated above. There is a wide range of dimensions in which the invention is effective. The principal consideration is that the dimensions of the holes, and the chunks or chips removed therefrom as referred to below, are of substantial size so as to hold the top layer of loosened snow 104' in position on the bottom layer, against the tendency for it to be dislodged as being "ski-ed off". A further important consideration is that they be of greater size than the mere incidental or accidental holes made by pins or nails made by other implements. They are effective for receiving and holding snow, including pieces and chunks of substantial size. Furthermore, these holes are formed in hard snow, and their integrity is thereby maintained.

The bottom layer 86 is shown in FIG. 12 and an important feature is that the top surface of that layer not be flat or smooth. By the nature of the operation of the method, that top surface is somewhat jagged, rather than smooth or flat or planar. FIG. 12 includes a line 106 indicating the "top surface" of the bottom layer 86, but the position of the "top surface" is vague and it does not exist at any one exact level. The holes 70 are of course generally conical, tapering downwardly, and the upper portions of the surfaces between adjacent holes converge upwardly, beyond which are peaks 108. These peaks are portions of a ridge, or network of ridges between the various holes and they would vary in depth somewhat of course, changing the effect of depth of the holes, at various locations. These peaks or ridges 108, constitute another element of the overall pattern of dimensions, but the total effect of the formation of the holes is to provide such holes of the approximate dimensions mentioned, and the approximate spaces therebetween.

The spikes of the spiders do not merely penetrate into the snow, but cut and lift out chunks or chips in forming the holes, and these chunks are of various sizes, as large as two inches across or in diameter corresponding to the size of the holes in that direction referred to above. These chunks of course are not accurately round, but they are not particularly greater in any one transverse direction than in any other and for convenience, diameter refers to transverse dimension. Most of the chunks are somewhat triangular in vertical corss section, or pyramidal shaped, while many are round or roundish in that direction, leaving holes that are generally cup shaped. In addition to the two inch chunks, others are also lifted, smaller in dimension, some in the form of smaller chunks but also many particles smaller, forming a rather snowy or fine mixture.

FIG. 13 represents diagrammatically one phase or condition of the snow after the snow breaker has passed thereover. As above indicated the large chunks 102 are about the largest size that occur. Many smaller ones, also as referred to, are shown at 112 which are of indeterminate size, but smaller than the large ones 102. The large ones fall into the holes 70 and being similar in dimension to the holes, they remain adjacent the top of the holes, being wedged at that position. The smaller ones 112 are interspersed with the larger ones at random, and not necessarily in any particular position or direction. Some of course may fall into the holes under the larger ones, but not in great numbers, and others will be interspersed with the large ones, and most of them on top, over the larger ones.

Passing the roller 96 over the loosened snow then crushes many of the particles, the larger ones being reduced in size, perhaps to in the neighborhood of 1 inch across. These then fall or are forced into the holes 70 to a greater depth as indicated in FIG. 14, these chunks being identified 102'. They fall into the hole in the neighborhood of half the depth of the holes, and the chunks this size still remain in large numbers and are stacked upwardly somewhat from the middle of the holes, but the roller also produces many particles that are much smaller, as indicated at 114, and much snow of very fine or granular form indicated at 118. The smaller particles tend to fall downwardly in the spaces between the bigger ones somewhat, but the general positioning of the various particles is established by the snow breaker 26, and then when the roller is passed thereover, the topmost particles are crushed to fine size and remain adjacent the top. This topmost portion of the loosened snow then is of very fine form, similar to fresh fallen fine snow.

As indicated above the holes 70 are in the neighborhood of 2 inches deep, and the snow breaker 26 penetrates into the snow to an extent of in the neighborhood of 4 inches, the radially outermost, or lowermost, portions of the spikes forming the holes, and as they pass through the top layer 88, they dislodge it to form the loosened snow 104. The snow breaker 26 in loosening the snow, produces a fluffing effect, and the top 104 is thereby made higher or deeper than the original layer of hard snow, this relationship being shown by the lines 106 in FIG. 11. This loosened snow occupies the depth also in the neighborhood of 2 inches or more and it assumes a level sometimes above the original layer 88, as indicated in FIG. 11. The roller 96 compacts the top layer 104 to a depth of about half its original depth, or about one inch, and this relationship to the area 92 is indicated at 107. Thus the final layer 104' of loosened snow is in the neighborhood of one inch thick.

The size of the holes, and the consequent size of the chunks dug therefrom, produce a layer of loosened snow over the bottom layer of hard snow, of sufficient depth for ski-ing thereon. The layer of loose snow must of course have a certain depth, of practical dimensions, to accommodate the skis and hence it is not possible to give accurate dimensions or limits of size of the holes. The size of the holes in addition to determining the character of the top loosened snow, also in themselves, by their size are effective for holding the loosened snow in position against the tendency to dislodge it, by ski-ing. These holes extend of course throughout the entire treated area, or ski trail, each holding a certain quantity of loosened snow, and altogether they hold the entire top layer of loosened snow as a continuous blanket throughout the area. The forces exerted by the skier, tending to dislodge the snow, are sometimes great, such as in making turns when the skis are turned considerably upright with the flat sides pushing laterally and consequently pushing the snow out of position. In the present case because of the rough surface of the bottom layer, the snow is tenaciously held in place. The walls of the holes have a great vertical component and thus hold the large chunks, and all chunks, in the holes; the chunks extend above the tops of the holes and they in turn provide a rough surface with a substantial vertical component to hold the particles of snow that are above them. This effect continues upwardly so that there is a gradual holding effect from within the holes to the very top of the top layer of loosened snow. This is in great contrast with previously known methods wherein the top position of the snow is cut by a straight blade, leaving a flat smooth surface on the bottom layer, and the snow in that case is easily dislodged from the smooth surface. This effect is also carried out on a hill or slope. In FIG. 15 a hill 118 has a surface at a great angle to the horizontal indicated at 120. Notwithstanding the substantial slope in many ski trails, the angle of the walls of the holes is greater than all ski slopes, and consequently the holes still have a substantial vertical component to hold the loosened snow on the surface. In this figure, the depth of the hole represented by the line 121 has a great vertical component as evidenced by comparison with the projection on the vertical line 123.

The condition of the snow as thus treated is also greatly advantageous in holding the loose snow against wind. Snow that is all of small particles, entirely granular, is easily blown and dislodged by wind, and this is particularly a drawback where the under surface is smooth as in previously known methods. In the present case where the snow is in gradations of fineness from the top down, there is a continuity of holding effect, first by the holes, and then by the large chunks and continuously and to a lesser extent, upwardly by the smaller and finer particles. In the case of extremely high winds, the rolling or crushing step may be omitted, to reduce the amount of fine snow that may be more easily blown away by the wind.

The condition of the snow has a still greater advantage in withstanding the deleterious effects of rain. In previous cases where a bottom layer presented a smooth or flat upper surface, with loose snow thereon, rain soaks through or runs through the loosened snow and upon meeting the smooth surface of the bottom layer, it runs thereover without much retarding effect. On a slope it runs a considerable length and will eventually accumulate in large areas and form a solid sheet. In the present case, the rain runs into the holes and it is held almost entirely without running effect, that is, in a matter of a few inches, all of the rain will have fallen into the holes. Thus the great accumulation of rain water as in other instances is avoided. The running effect in previous methods produces puddles when the ground may flatten out only a little, with consequent undesirable sheets of ice formed. In the present case the retarding effect on the rain takes place whether it is cold weather or warm weather and even if the snow is melting.

The staggered relation of the holes 70 is beneficial in producing a more complete cover pattern, in contrast to an arrangement of distinct separate and spaced rows, in that there are no longitudinal flat spaces between rows. This in particularly benefitial on hills.

Another great advantage of the invention is that, on occasion a crust will form over a bottom layer of soft snow, due to unusual circumstances. This crust of course may be broken, and various kinds of apparatus have been used heretofore for that purpose but the apparatus of the present invention is the most effective among all such apparatuses known in conditioning such snow.

A still further situation where the present invention is greatly advantageous is in the case where thin layer, for example of about 2 inches, of light fluffy snow overlies a hard base beneath. The light fluffy snow is very unstable, because of the thinness thereof and it can be ski-ed off very easily down to the hard snow. The apparatus of the present invention can be utilized and it penetrates the hard snow and breaks it up, and mixes chunks formed from it with the light snow, and stabilizes the whole mass. Chunks of a great range of sizes are formed, as well as a certain quantity of small particles and the whole mixture forms a stable mass. In this case also, the rough undersurface is a principal factor in stabilizing the top layer of loose snow.

In considering the optimum size, proportion and spacing of the holes, the magnitude of the forces involved should be considered,—an adult, often of great weight, ski-ing on the loose snow, and the object being to retain the loose snow in position under the effect of such great forces.

A further great advantage of the invention is that a minimum of power is required to operate the apparatus, as compared to other known apparatus.

I claim:

1. A method of breaking hard snow in the form of a continuous main layer of substantial depth on the ground, comprising the steps, pulling a rotary spiked tool, by and after a traction implement, having a plurality of spikes distributed around and along the tool, and thereby driving the spikes into the main layer to a predetermined depth and forming holes by the spikes reaching to that predetermined depth, so forming the holes of about two inches in width at the top, and tapering downwardly, the forming of the holes resulting in loosening and dislodging snow therefrom in the form of chunks, and smaller pieces, at least a substantial portion of the chunks being of a transverse width similar to that of the holes at the top of the holes, forming a top layer of said loosened and dislodged snow, continuous in extent and being less, in quantity of mass, than the total mass of the main layer, and retaining a continuous bottom layer of hard snow containing the holes, the top layer thereby lying on the bottom layer, and effecting the falling of the chunks and loosened snow, in part, into the holes and holding them in position on the bottom layer by the holes, against forces tending to dislodge the loosened snow from that position on the bottom layer.

2. A method according to claim 1 and including the step, forming a top surface on the bottom layer, around the holes, which is non-planar, and rough and jagged, in contour.

3. A method according to claim 2 and including the step, forming said top surface as a network of ridges extending substantially throughout the area of the bottom layer, and rising upwardly generally as continuous extensions of the surfaces of the holes.

4. A method according to claim 1 and including the step, forming the holes of a depth similar to their diameter.

5. A method according to claim 1 and including the step, spacing the holes a distance apart a distance similar to twice the diameter of the holes.

6. A method according to claim 1 and including the step, rolling the top layer of loosened snow, and thereby reducing a substantial proportion of the chunks in size.

7. A method according to claim 6 and including the step, so reducing the size of the chunks to about half their original size.

8. A method according to claim 6 and including the steps, forming a portion of the loosened snow in the form of fine snow, effecting the positioning of a portion of the chunks downwardly through the top layer and partially into the holes, and positioning the fine snow generally at the top portion of the top layer and also downwardly through the chunks.

9. A method according to claim 4 wherein, the holes, progressing longitudinally, are staggered.

* * * * *